United States Patent [19]

Häring

[11] Patent Number: 4,877,552

[45] Date of Patent: Oct. 31, 1989

[54] CORROSION INHIBITOR

[75] Inventor: Ulrich Häring, Riehen, Switzerland

[73] Assignee: Ciba-Geigy Corporation, Ardsley, N.Y.

[21] Appl. No.: 91,156

[22] Filed: Aug. 28, 1987

[30] Foreign Application Priority Data

Sep. 2, 1986 [CH] Switzerland ..... 3514/86

[51] Int. Cl.[4] ..... C23F 11/10

[52] U.S. Cl. ..... 252/392; 422/16; 106/14.16

[58] Field of Search ..... 252/392 A P S; 422/16; 106/14.16

[56] References Cited

U.S. PATENT DOCUMENTS

| | | | |
|---|---|---|---|
| 2,468,163 | 4/1949 | Blair et al. | 252/8.555 |
| 2,889,193 | 6/1959 | Denman et al. . | |
| 3,625,859 | 12/1971 | Hashimoto et al. | 252/392 |
| 4,402,907 | 9/1983 | Clark | 252/392 X |
| 4,517,114 | 5/1985 | Oppenlaender et al. . | |

FOREIGN PATENT DOCUMENTS

| | | | |
|---|---|---|---|
| 1150042 | 7/1983 | Canada | 252/392 |
| 0041039 | 12/1981 | European Pat. Off. . | |
| 2304163 | 8/1974 | Fed. Rep. of Germany . | |

OTHER PUBLICATIONS

Chem. Abstract, 92, 151729v, (1980).

*Primary Examiner*—John F. Terapane
*Assistant Examiner*—Gary Geist
*Attorney, Agent, or Firm*—Harry Falber; Joann Villamizar

[57] ABSTRACT

Corrosion inhibitors comprising (a) an imidazoline of the formula I

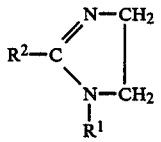

(I)

in which $R^1$ is hydrogen, $C_1$–$C_6$-hydroxyalkyl, $C_1$–$C_6$-aminoalkyl or $C_2$–$C_{19}$-carboxyalky or an ammonium or amine salt thereof and $R^2$ is hydrogen, $C_1$–$C_{17}$-alkyl or $C_2$–$C_{17}$-alkenyl, (b) a heterocyclic polyacid of the formula II

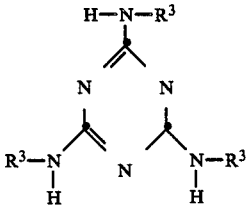

(II)

in which $R^3$ is $C_2$–$C_6$-carboxyalkyl or an alkali metal, alkaline earth metal, ammonium or amine salt thereof, (c) at least one alkanolamine of the formula III

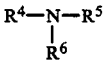

(III)

in which $R^4$ is $C_1$–$C_6$-hydroxyalkyl and $R^5$ and $R^6$, which can be identical or different, are hydrogen, $C_1$–$C_6$-alkyl or $C_1$–$C_6$-hydroxyalkyl, and (d) water are outstandingly suitable for the corrosion-inhibiting treatment of shaped iron and steel parts.

19 Claims, No Drawings

CORROSION INHIBITOR

The present invention relates to a corrosion inhibitor comprising an imidazoline, a heterocyclic polyacid, at least one alkanolamine and water, and to an aqueous system or water- and oil-based emulsion containing such a corrosion inhibitor.

Large quantities of semi-finished iron and steel parts are put into temporary storage unit they are processed further. During this time, they are exposed to the influences of the environment. In order to protect these semi-finished parts especially from corrosion, it is necessary to apply a corrosion hibitor to them. Since, however, the further processing of these semi-finished iron and steel parts demands cleaned surfaces, a corrosion inhibitor for use in this way must be easily removable at the right time, but without being detached from the protected surface by weathering influences.

Corrosion inhibitors dissolved in organic solvents are mainly used in this field. The disadvantages arising in this case are, apart from technical disadvantages such as insufficient application of corrosion inhibitor or inadequate adhesion, especially also ecological disadvantages, such as disposal of the solvents which are used for removing the corrosion inhibitors.

Thus, Canadian patent specification No. 1,150,042 has disclosed a corrosion-inhibiting composition for ferrous metals, which contains an N-acyl-sarcosine and an imidazoline as the active components, a mineral oil being used as an adhesive promoter. Moreover, imidazoles as volatile corrosion inhibitors which can be washed off with water are known from German Offenlegungsschrift 2,304,163.

In addition, a mixture of benzotriazole and/or imidazole derivatives and a triazine derivative is known as a corrosion inhibitor for copper pipes in water mains from Japanese Published Application No. 54-148,148.

The present invention relates to a corrosion inhibitor comprising (a) an imidazoline of the formula I

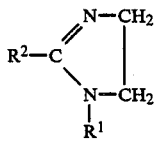

(I)

in which $R^1$ is hydrogen, $C_1$–$C_6$-hydroxyalkyl, $C_1$–$C_6$-aminoalkyl or $C_2$–$C_{19}$-carboxylalkyl or an ammonium or amine salt thereof and $R^2$ is hydrogen, $C_1$–$C_{17}$-alkyl or $C_2$–$C_{17}$-alkenyl, (b) a heterocyclic polyacid of the formula II

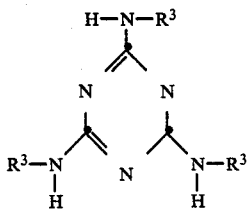

(II)

in which $R^3$ is $C_2$–$C_6$-carboxylic or an alkali metal, alkaline earth metal, ammonium or amine salt thereof, (c) at least one alkanolamine of the formula III

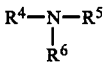

(III)

in which $R^4$ is $C_1$–$C_6$-hydroxyalkyl and $R^5$ and $R^6$, which can be identical or different, are hydrogen, $C_1$–$C_6$-alkyl or $C_1$–$C_6$-hydroxyalkyl, and (d) water.

$C_1$–$C_{17}$-Alkyl $R^2$ is straight-chain or branched alkyl, for example methyl, ethyl, n-propyl, isopropyl, n-butyl, isobutyl, sec.-butyl, tert.-butyl, straight-chain or branched pentyl, hexyl, heptyl, octyl, nonyl, decyl, undecyl, dodecyl, tridecyl, tetradecyl, pentadecyl, hexadecyl or heptadecyl.

$C_2$–$C_{17}$-Alkenyl radicals $R^2$ are straight-chain or branched alkenyl containing one or more, but preferably one double bond, for example vinyl, allyl, n-butenyl, iso-pentenyl, pentenyl, hexenyl, heptenyl, octenyl, nonenyl, decenyl, undecenyl, dodecenyl, tridecenyl, tetradencyl, pentadecenyl, hexadecenyl or heptadecenyl, but preferably heptadecenyl.

$C_1$–$C_6$-Alkyl $R^5$ and $R^6$ are straight-chain or branched alkyl, for example methyl, ethyl, n-propyl, isopropyl, n-butyl, isobutyl, sec.-butyl, tert.-butyl, straight-chain or branched pentyl or hexyl.

In $C_1$–$C_6$-hydroxyalkyl $R^1$, $R^4$, $R^5$ and $R^6$, the $C_1$–$C_6$-alkyl can be monosubstituted or polysubstituted, but preferably monosubstituted by hydroxyl groups, substitution being possible in any position but being preferably terminal in the case of monosubstitution. Examples are hydroxymethyl, 2-hydroxyethyl, 3-hydroxypropyl, 1,3-dihydroxyisopropyl, 2,4-dihydroxybutyl, trihydroxy-tert.-butyl, 2,3,4,5-tetrahydroxypentyl or 6-hydroxyhexyl, but preferably 2-hydroxyethyl.

In $C_1$–$C_6$-aminoalkyl $R^1$, the $C_1$–$C_6$-alkyl can be monosubstituted or polysubstituted, but preferably monosubstituted by amino groups, substitution being possible in any position but preferably being terminal in the case of monosubstitution. Examples are aminomethyl, 2-aminoethyl, 2,3-diaminopropyl, 3-amino-2,2-dimethylpropyl or 6-aminohexyl.

$C_2$–$C_{19}$-Carboxyalkyl $R^1$ and $C_2$–$C_6$-carboxyalkyl $R^3$ are $C_1$–$C_{18}$-alkyl or $C_1$–$C_5$-alkyl monosubstituted by —COOH, substitution being possible in any position but preferably being terminal, examples being carboxymethyl, 2-carboxyethyl, 3-carboxypropyl, 4-carboxybutyl or 5-carboxypentyl and also, in the case of $R^1$, 6-carboxyhexyl, 7-carboxyheptyl, 8-carboxyoctyl, 9-carboxynonyl, 10-carboxydecyl, 11-carboxyundecyl, 12-carboxydodecy, 13-carboxytridecyl, 14-carboxytetradecyl, 15-carboxypentadecyl, 16-carboxyhexadecyl, 17-carboxyheptadecyl or 18-carboxyoctadecyl.

In $R_1$ and $R^3$ as an amine salt of $C_2$–$C_{19}$-carboxyalkyl or $C_2$–$C_6$-carboxyalkyl, the amine is preferably an amine having up to 8 C atoms, which can be OH-substituted, for example methylamine, ethylamine, propylamine, butylamine, hexylamine, octylamine or mono-, di- or tri-ethanolamine.

An alkali metal salt of $C_2$–$C_6$-carboxyalkyl as $R^3$ is, for example, the sodium, potassium or lithium salt.

An alkaline earth metal salt of $C_2$–$C_6$-carboxyalkyl as $R^3$ is, for example, the calcium or magnesium salt.

A corrosion inhibitor, in which $R^1$ in the formula is $C_1$–$C_3$-hydroxyalkyl or $C_2$–$C_6$-aminoalkyl, is preferred.

A corrosion inhibitor, in which $R^1$ in the formula I is 2-hydroxyethyl, is particularly preferred.

A further embodiment is a corrosion inhibitor, in which $R^2$ is the formula I is $C_{11}$–$C_{17}$-alkyl or $C_{12}$–$C_{17}$-alkenyl.

A specially preferred embodiment is a corrosion inhibitor, in which $R^2$ in the formula I is $C_{11}$-alkyl.

A likewise particularly preferred embodiment is a corrosion inhibit or, in which $R^2$ in the formula I is $C_{17}$-alkenyl.

One embodiment is a corrosion inhibitor, in which $R^3$ in the formula II is $C_4$–$C_6$ carboxyalkyl. A corrosion inhibitor, in which $R^3$ in the formula II is $C_6$-carboxyalkyl, is also preferred.

A corrosion inhibitor, in which $R^4$ in the formula III is 2-hydroxyethyl, is of particular interest.

A corrosion inhibitor, in which $R^5$ in the formula III is $C_1$–$C_6$-hydroxyalkyl, is also of great interest.

A corrosion inhibitor, in which $R^5$ in the formula III is 2-hydroxyethyl is especially interesting.

A corrosion inhibitor, in which $R^4$ and $R^5$ of the formula III are 2-hydroxyethyl, is very particularly interesting.

A corrosion inhibitor, in which $R^5$ and $R^6$ in the formula III are $C_1$–$C_6$-hydroxyalkyl, is also of interest.

Moreover, a corrosion inhibitor, in which $R^5$ and $R^6$ in the formula III are 2-hydroxyethyl, is of interest.

A corrosion inhibitor, in which the alkanolamine in the formula III is triethanolamine, is of very special interest.

A corrosion inhibitor, in which component (c) is a mixture of ethanolamine, diethanolamine and triethanolamine, is likewise of great interest.

Examples of compounds of the formula I are:

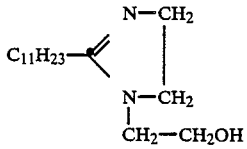

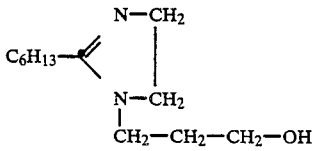

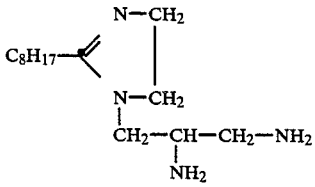

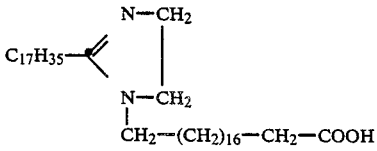

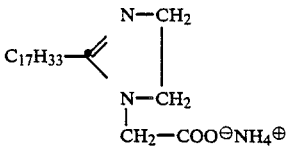

-continued

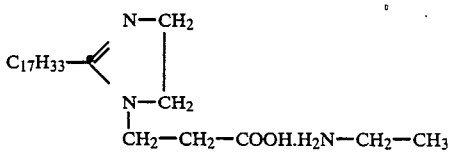

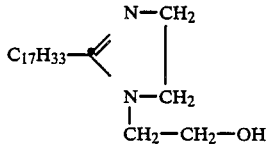

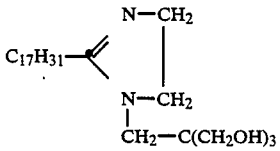

Examples of compounds of the formula II are: 2,4,6-tris-(5'-carboxypentylamino)-1,3,5-triazine, 2,4,6-tris-(3'-carboxypropylamino)-1,3,5-triazine, 2,4,6-tris-(2'-carboxyethylamino)-1,3,5-triazine, 2,4,6-tris-(carboxymethylamino)-1,3,5-triazine and 2,4,6-tris-(3'-carboxybutylamino)-1,3,5-triazine.

Examples of compounds of the formula III are: monoethanolamine, 3-aminopropanol, 2-dimethylaminoethanol, 1-dimethylamino-2-propanol, 2-dibutylaminoethanol, 2-hexylaminobutanol, diethanolamine, triethanolamine or mixtures thereof.

Some of the compounds of the formulae I, II and III are known and commercially available. The novel compounds are prepared analogously to the preparation processes cited below.

The preparation of the compounds of the formula I is described, for example, in U.S. Pat. Nos. 2,267,965, 2,355,837 and 2,992,230.

The preparation of the compounds of the formula II is described, for example, in Nestler et al., J. Prakt. Chem., volume 22, pages 173–185 81963).

Regarding the preparation of the compounds of the formula III, reference may be made in the review article "Alkanolamines" by Richard M. Mullins in Kirk-Othmer "Encyclopedia of Chemical Technology", 3rd edition, John Wiley & Sons, New York 1978, volume 1, pages 944–960.

The corrosion inhibitor according to the invention can be prepared, for example, by adding a heterocyclic polyacid of the formula II to a mixture of at least one alkanolamine of the formula III and water with stirring at room temperature and subsequently adding an imidazoline of the formula I, likewise with stirring at room temperature.

The corrosion inhibitor according to the invention is in the liquid state. However, its viscosity changes depending on the ratio of a:b:c:d.

The ratio of b:c:d is selected with advantage such that the mixture of the three components concerned is in the liquid state. However, a b:c:d ratio of 1:2:1 is preferred. The a:e ratio (with b+c+d=e) can be 1:1 to 1:80, but is preferably between 1:2 and 1:40.

The corrosion inhibitor according to the invention is outstandingly suitable as a temporary corrosion inhibitor for shaped iron and steel parts, for example car body panels, and can easily be removed by ecologically acceptable methods, for example washing with water.

The corrosion inhibitor according to the invention is preferably applied as a solution ready for use in aqueous systems or in water/oil emulsions.

Consequently, the present invention also relates to a composition comprising an aqueous system or a water-/oil emulsion and a corrosion inhibitor containing (a) an imidazoline of the formula I, (b) a heterocyclic polyacid of the formula II, (c) at least one alkanolamine of the formula III and (d) water. This composition can also be described as a solution ready for use.

Examples of such aqueous systems are water itself and blends of alcohols, especially polyhydric alcohols, for example ethylene glycol, diethylene glycol, polyethylene glycol, propylene glycol or/and mixed glycols, with water.

Examples of the oil component in water/oil emulsions are mineral oils, for example paraffin oils, synthetic lubricants such as synthetic hydrocarbons or mixtures of such lubricants or mineral oils.

The solution ready for use can be prepared by diluting the corrosion inhibitor according to the invention with the aqueous system or the water/oil emulsion. It is also possible, however, to prepare the mixture of the components of the formulae II and III in water and to add the component of the formula I only during or after the addition of the mixture to the aqueous system or water/oil emulsion.

The composition according to the invention, namely the aqueous systems or water/oil emulsions (solutions ready for use) contain preferably 0.02–5% by weight of an imidazoline of the formula I, 0.02–5% by weight of a heterocyclic polyacid of the formula II and 0.1–15% by weight of at least one alkanolamine of the formula III, but in particular 0.1–2% by weight of an imidazoline of the formula I, 0.1–2% by weight of a heterocyclic polyacid of the formula II and 0.5–10% by weight of at least one alkanolamine of the formula III, relative to the aqueous system or water/oil emulsion.

Apart from the components (a), (b), (c) and (d), the aqueous stems or water/oil emulsions can also contain further additives, for example emulsifiers, metal passivators, rust inhibitors and/or biocides.

Examples of such additives are given below.

EXAMPLES OF EMULSIFIERS

1. Anionic emulsifiers

Salts of sulfonic acids, salts of carboxylic acids, salts of acylated amidocarboxylic acids and salts of phosphoric acid esters.

2. Cationic emulsifiers

Salts of fatty amines and alkylimidazolinium salts.

3. Non-ionic emulsifiers

Polyglycol ethers of alcohols, phenols such as nonylphenol, fatty acids such as ricinoleic acid, fatty amines, fatty acid amides and fatty acid esters of polyhydric alcohols, for example sorbitol oleate.

EXAMPLES OF METAL PASSIVATORS

For non-ferrous metalls such as metals from colored ores, for example: triazole, benzotriazole and derivatives thereof, 2-mercaptobenzothiazole, 2,5-dimercaptothiadiazole, salicylidene-propylenediamine and salts of salicylaminoguanidine.

EXAMPLES OF RUST INHIBITORS (a) Organic acids, their esters, metal salts and anhydrides, for example: N-oleoyl-sarcosine, sorbitan monooleate, lead naphthenate, dodecenylsuccinic anhydride, alkenylsuccinic acid half-esters and 4-nonylphenoxyacetic acid.

(b) Nitrogen-containing compounds, for example: I. Primary, secondary or tertiary aliphatic or cycloaliphatic amines and amine salts of organic and inorganic acids, for example oil-soluble alkylammonium carboxylates. II. Heterocyclic compounds, for example: substituted imidazolines and oxazolines.

(c) Phosphorus-containing compounds, for example: amine salts of phosphoric acid partial esters.

EXAMPLES OF BIOCIDES

Boron esters, salts of 2-pyridinethiol, phosphonium salts, s-triazines and benzoisothiazolinones.

In the examples which follow, parts and percentages are by weight, unless otherwise stated.

Example 1

4parts of 2,4,6-tris-(5'-carboxypentylamino)-s-triazine and 1 part of 2-(8-heptadecenyl)-4,5-dihydro-1-(2-hydroxyethyl)-imidazole are added at room temperature with stirring to a mixture of 8 parts of triethanolamine and 4 parts of water, and the mixture is stirred until a clear, amber-coloured liquid has formed.

Viscosity at 40° C.: 100 $mm^2$/second

Density at 23° C.: 1.15 $g/cm^3$

The solution ready for use is obtained by diluting 3.2 parts of the above concentrate with 96.8 parts of distilled water.

Examples 2–5

1 part of 2,4,6-tris-(5'-carboxypentylamino)-s-triazine is added at room temperature with stirring to a mixture of 2 parts of triethanolamine and 1 part of water, and the mixture is stirred until a clear liquid A has formed. The finished solution ready for use is obtained by stirring x parts of the liquid A and y parts of components $a_1$ at room temperature into (100-x-y) parts of distilled water.

| Example No. | x parts of liquid A | y parts of component $a_1$ |
|---|---|---|
| 2 | 2 | 0.3 |
| 3 | 1 | 0.5 |
| 4 | 1 | 0.2 |
| 5 | 5 | 0.2 |

Component $a_1$ = 2-(8-heptadecenyl)-4,5-dihydro-1-(2-hydroxy-ethyl)-imidazole

Examples 6 and 7 x parts of liquid A obtained according to Examples 2–5 and y parts of components $a_1$ or $a_2$ are stirred at room temperature into (100-x-y) parts of a mixture consisting of 9 parts of water and 1 part of propylene glycol.

| Example No. | x parts of liquid A | y parts of component $a_1$ or $a_2$ |
|---|---|---|
| 6 | 3.6 | 0.2 ($a_1$) |
| 7 | 3.6 | 0.2 ($a_2$) |

Component $a_2$ = 2-(undecyl)-4,5-dihydro-1-(2-hydroxyethyl)-imidazole

Example 8

Testing of corrosion inhibitors for corrosion-preventing properties according to DIN 51,359

The method according to this standard serves to establish the corrosion-preventing properties of the corrosion inhibitors on steel sheet under constant damp heat conditions at 50° C. with continuous air supply.

Preparation for the test

For this purpose, 3 steel sheets of steel according to American Specification QQ-S-698, grade 1009, of dimensions 100×50×3 mm are prepared as follows.

The corrosion inhibitor adhering to the steel sheets is washed off with white spirit (DIN 51,632) and the steel sheets are carefully checked for pits, scratches or rust. Imperfect sheets are separated out. After the corrosion inhibitor has been removed, the steel sheets must no longer be touched by hand.

The edges and surfaces of the steel sheets are then rubbed with abrasive cloth (standard corundum of P 240 grain size). The dust produced by the rubbing is removed with cottonwool dipped in white spirit, until the cottonwool remains clean. Each steel sheet thus prepared is stored at room temperature in a beaker filled with 2-propanol, until all the steel sheets required for a test have been prepared. The steel sheets are then individually placed for 5 minutes into hot white spirit of about 65° C. and then moved to and fro for 10 seconds in boiling 2-propanol. The dry steel sheets are to be stored in a desiccator and used for the test on the same day.

The humidity cabinet is adjusted to an air rate of 875 l/h±25 l/h, to an air temperature of (50±1)°C. and a relative air humidity of 100%.

Test procedure

The sample, in a beaker, of a solution ready for use of the corrosion inhibitor to be tested should be at room temperature for the immersion step. The prepared steel sheets are taken out of the desiccator by means of tweezers and individually immersed fully for 10 seconds into the sample, using a hook, withdrawn and, after dripping off for 10 seconds, again immersed into the sample for 1 minute with gentle movement to and fro. The steel sheet is then suspended in a non-corrosive atmosphere at room temperature for about 2 hours, to allow excess corrosion inhibitor to drip off and to form a uniform coherent film of the sample on the steel sheet test surface which is to be assessed. The steel sheets thus treated are introduced into the humidity chamber. The steel sheets are checked every 24 hours for corrosion phenomena.

Evaluation:

The steel sheets taken out of the humidity chamber are washed off with a mixture of white spirit and pure toluene, and the test surface is checked within 10 minutes for corrosion phenomena under a 100 W daylight lamp. The corrosion rating is determined for every test area of the steel sheets, grey discolorations and also corrosion phenomena outside the test are being disregarded. The assessment is made in accordance with the following system:

| Corrosion rating | Description |
|---|---|
| 0 | No corrosion: unchanged |
| 1 | Traces of corrosion: at most three corrosion points, none of which has a diameter of more than 1 mm. |
| 2 | Slight corrosion: up to 5% of the surface corroded. |
| 3 | Moderate corrosion: more than 5 and up to 20% of the surface corroded. |
| 4 | Severe corrosion: more than 20% of the surface corroded. |

To be able to provide comparative information, the time in hours required until the mean corrosion rating 1 is reached is stated in practice. The mean corrosion rating is identical to the average of the corrosion ratings of the 6 test areas of the 3 steel sheets.

Result

The results are shown in Table 1.

| Corrosion inhibitor Example No. | Time [hours] to reach the mean corrosion rating 1 |
|---|---|
| 1 | 88 |
| 2 | 80 |
| 3 | 100 |
| 5 | 100 |
| 6 | 124 |
| 7 | 123 |
| without | <16 |

What is claimed is:

1. A corrosion inhibitor comprising (a) an imidazoline of the formula I

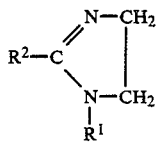

(I)

in which $R^1$ is hydrogen, $C_1$–$C_6$-hydroxyalkyl, $C_1$–$C_6$-aminoalkyl or $C_2$–$C_{19}$-carboxyalkyl or an ammonia or amine salt thereof and $R^2$ is hydrogen, $C_1$–$C_{17}$-alkyl or $C_2$–$C_{17}$-alkenyl, (b) a heterocyclic polyacid of the formula II

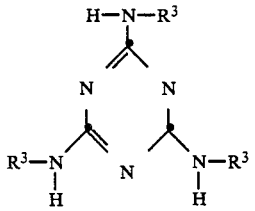

(II)

in which $R^3$ is $C_4$–$C_6$-carboxyalkyl or an alkali metal, alkaline earth metal, ammonium or amine salt thereof, (c) at least one alkanolamine of the formula III

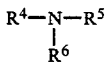

(III)

in which $R^4$ is $C_1$–$C_6$-hydroxyalkyl and $R^5$ and $R^6$, which can be identical or different, are hydrogen, $C_1$–$C_6$-alkyl or $C_1$–$C_6$-hydroxyalkyl, and (d) water, wherein the ratio a:e (with b+c+d=e) is 1:1 up to 1:80.

2. A corrosion inhibitor according to claim 1, wherein $R^1$ in the formula I is $C_1$–$C_3$-hydroxyalkyl or $C_2$–$C_6$-aminoalkyl.

3. A corrosion inhibitor according to claim 2, wherein $R^1$ in the formula I is 2-hydroxyethyl.

4. A corrosion inhibitor according to claim 1, wherein $R^2$ in the formula I is $C_{11}$–$C_{17}$-alkyl or $C_{12}$–$C_{17}$-alkenyl.

5. A corrosion inhibitor according to claim 4, wherein $R^2$ in the formula I is $C_{11}$-alkyl.

6. A corrosion inhibitor according to claim 4, wherein $R^2$ in the formula I is $C_{17}$-alkenyl.

7. A corrosion inhibitor according to claim 1, wherein $R^3$ in the formula II is $C_6$-carboxyalkyl.

8. A corrosion inhibitor according to claim 1, wherein $R^4$ in the formula III is 2-hydroxethyl.

9. A corrosion inhibitor according to claim 1, wherein $R^5$ in the formula III is $C_1$–$C_6$-hydroxyalkyl.

10. A corrosion inhibitor according to claim 9, wherein $R^5$ in the formula III is 2-hydroxyethyl.

11. A corrosion inhibitor according to claim 1, wherein $R^4$ and $R^5$ in the formula III are 2-hydroxyethyl.

12. A corrosion inhibitor according to claim 1, wherein $R^5$ and $R^6$ in the formula III are $C_1$–$C_6$-hydroxyalkyl.

13. A corrosion inhibitor according to claim 12, wherein $R^5$ and $R^6$ in the formula III are 2-hydroxyethyl.

14. A corrosion inhibitor according to claim 1, wherein $R^4$, $R^5$ and $R^6$ in the formula III are 2-hydroxyethyl.

15. A corrosion inhibitor according to claim 1, wherein component (c) is a mixture of ethanolamine, diethanolamine and triethanolamine.

16. A composition comprising an aqueous system or a water/oil emulsion and a corrosion inhibitor according to claim 1.

17. A composition according to claim 16, wherein the content of imidazoline of the formula I is 0.02–5% by weight, that of the heterocyclic polyacid of the formula II is 0.02–5% by weight and that of the alkanolamine, of which there is at least one, of the formula III is 0.1–15% by weight.

18. A composition according to claim 17 wherein the content of the imidazoline of the formula I is 0.1–2% by weight, that of the heterocyclic polyacid of the formula II is 0.1–2% by weight and that of the alkanolamine, of which there is at least one, of the formula III is 0.5–10% by weight.

19. A process for inhibiting the corrosion of shaped iron and steel parts by applying a corrosion inhibitor as described in claim 1 on the surfaces thereof.

* * * * *